US005442427A

United States Patent [19]

Day

[11] Patent Number: 5,442,427

[45] Date of Patent: Aug. 15, 1995

[54] CONCENTRATE STIRRING FOR CONTINUOUS PRINTING

[75] Inventor: Gene F. Day, Hillsborough, Calif.

[73] Assignee: Phoenix Precision Graphics, Inc., Sunnyvale, Calif.

[21] Appl. No.: 131,468

[22] Filed: Oct. 4, 1993

[51] Int. Cl.[6] ..... G03G 15/10

[52] U.S. Cl. ..... 355/256; 430/117

[58] Field of Search ..... 355/256, 246; 430/115, 430/117; 118/659, 660

[56] References Cited

U.S. PATENT DOCUMENTS

| | | | |
|---|---|---|---|
| 4,860,050 | 8/1989 | Kurotori et al. | 355/256 |
| 4,974,024 | 11/1990 | Bares et al. | 355/246 |
| 4,980,259 | 12/1990 | Landa et al. | 430/117 |
| 5,003,352 | 3/1991 | Duchesne et al. | 355/256 |
| 5,155,001 | 10/1992 | Landa et al. | 430/115 |

FOREIGN PATENT DOCUMENTS

| | | | |
|---|---|---|---|
| 58-186769 | 10/1983 | Japan | 355/256 |

*Primary Examiner*—Joan H. Pendegrass
*Attorney, Agent, or Firm*—Schneck & McHugh

[57] ABSTRACT

A method and apparatus for a continuous developing system for electrostatic printing in which a mixing means is disposed within a tank containing developer concentrate in order to maintain the concentrate in an homogenous solution. This mixing allows a concentration of dissolved charge agent in the concentrate to be greatly reduced, as the higher concentration of charge agent is no longer needed to prevent toner particles within the concentration from agglomerating. The lower concentration of charge agent facilitated by the concentrate mixing allows the concentrate to have a charge agent concentration as low as that favorable for the developing solution. The concentrate can therefore be combined with a carrier liquid to form a developer immediately before printing, rather than using premixed developer. The concentrate and the carrier can also be added continuously to replenish developer lost to printing without increasing the charge agent concentration in the developer to a point where the developer must be discarded. A purifier may be used in direct process printing to remove ionic contaminants, concentrate and carrier being added to replenish developer lost to purification, thereby avoiding the build up of contaminants in the developer which can also necessitate discard of the developer. The periodic discard and replacement of volumes of developer is avoided, being replaced with small additions of concentrate and discard of small chunks of waste.

20 Claims, 3 Drawing Sheets

CONCENTRATE STIRRING FOR CONTINUOUS PRINTING

TECHNICAL FIELD

The present invention relates to electrostatic printers, plotters and copiers that use liquid developer. More particularly, it relates to continuous use and purification of the developer.

BACKGROUND ART

The use of electrostatic latent images to cause liquid developer containing electrically charged, pigmented toner particles to form a visible image is well known. It is well known in the art to accomplish such printing by first creating a latent image on an intermediary surface, toning the latent image to make a visible image on the surface and then transferring that visible image to a recording medium such as paper. It is also known to form an image directly on a recording medium by depositing an electrostatic image onto a surface of that medium and then applying such toner to that surface. The former system is sometimes termed "transfer process" printing, whereas the latter system may be termed "direct process" printing.

The liquid developer is typically composed primarily of a non-polar, dielectric carrier liquid, such as "Isopar", a trademark of Exxon Corporation for certain aliphatic hydrocarbon liquids in which pigmented toner particles and charge agents are dispersed to make developer. The toner particles are typically combinations of polymer resins and colored pigments which adsorb the charge agents, thereby causing the particles to acquire an electrical charge and enabling their response to an electrostatic image. Typically, a large number of charge agent molecules adsorb onto a toner particle causing a small degree of ionization. Literally millions of charge agent molecules may attach themselves to a colored particle but the number of ionic charges produced is typically only about 10 to 100. The great majority of adsorbed charge agent molecules remain electrically neutral. Also, for each ionic charge produced on the surface of the particle a corresponding counter ion of opposite charge is produced in the surrounding carrier liquid. In this manner the developer as a whole remains electrically neutral. Over time thermodynamic equilibrium is reached and essentially every toner particle becomes charged. Some of the charge agent molecules may remain in solution rather than adsorbed onto a particulate surface.

Also incorporated in some liquid developers are stearic stabilizers, which are not electrically active but which coat the toner particles so as to prevent them from agglomerating in a hard mass, so that a small amount of stirring of the developer causes redispersion. The stearic stabilizers also serve to fix the dried image by gluing the toner particles to the surface of the recording paper. However, the stearic stabilizers may interfere with the adsorption and desorption of charge agents.

The developer is often supplied to a printing apparatus as a "pre-mix" because of a delay of perhaps one week after mixing before it is stabilized and thermodynamic equilibrium is reached. In this manner it can be used immediately without waiting for stabilization of the developer. This developer is held in a tank in the apparatus, and then pumped to an applicator for printing on the recording medium. Some printing apparatuses have a separate tank containing liquid carrier, and another tank containing a developer concentrate. For a color printer, a set of developers are contained in a set of tanks, each tank housing a developer of a different primary color, and a separate concentrate tank may be provided corresponding to each developer tank, with a wash tank for carrier liquid also provided.

The concentrate is essentially comprised of the elements contained in the developer but with a greatly reduced amount of carrier. The concentrate also typically contains a higher concentration of charge agent than does the developer. This excess charge agent is provided to keep the toner particles in an homogenous suspension so as to prevent their settling out. This higher level of charge agent causes an increased level of charge on the surfaces of the toner particles in the concentrate mix. The higher charge level causes increased mutual repulsion of the particles from each other so as to stabilize the concentrate liquid and delay or prevent particle settling and agglomeration into a solid mass or cake. The relatively high level of charge agent in the concentrate is also necessary because the concentrate, unlike the developer, is not stirred by repeated pumping to and from the applicator. Typically, the concentrate rests in a quiescent state and is only slightly disturbed when a small amount of concentrate is injected into a stream of developer as demanded by usage of a particular color. This quiescent state provides opportunity for particulate settling. If such settling were to occur it would be difficult or impossible for the injection system to work successfully.

After passing through the toner applicator to form an image, the spent liquid developer minus whatever toner particles were used in visible image formation is returned to its developer tank to be reused. In some printing systems, a small amount of concentrate is added to replenish the toner particles transferred to the medium, and some carrier is similarly added to the developer, the relative amounts added commonly dictated by optical sensing of toner particle concentration in the developer and by overall liquid level sensing in the developer tank.

As the developer is gradually replenished with concentrate, the higher concentration of charge agent in the concentrate raises the concentration of charge agent in the developer. The typically higher level of charge agent in the concentrate mix leads to various problems.

As the developer is used there is a steady increase in the concentration of charge agent in the developer tank. The excess charge agents in solution may become partially ionized leading to clear phase electrical conductivity which tends to compete directly with charged toner particles in responding to and neutralizing the electrostatic image. Hence, as the concentration of charge agent in the developer increases, the image produced on the recording medium becomes fainter because latent image neutralization is accomplished by both colored particles and by colorless ions. As more colorless ions replace more and more colored particles in the visible image, that image is seen to fade away.

The higher concentration of charge agent in the developer also leads to excess charge of the colored particles themselves. Even if there were no increase in colorless ions or in clear phase electrical conductivity, there would be fewer colored particles required to neutralize the latent image and the image would be seen to fade away. The increasing level of charge agents in the developer would lead to an increasing charge-to-mass ratio for the toner particles so that fewer of them would be able to neutralize the latent image. Thus, both an increase in colorless ions and increased particulate charge independently lead to image fading.

Furthermore, if a great amount of concentrate is added quickly to the developer as in the case of heavy usage of one color, the added colored particles do not have time to thermodynamically equilibrate to the reduced charge level of the developer, that is, they temporarily carry excess charge even while their charge level is continuously dropping to the lower (but increasing) level of the developer. This transient excess charge level of the newly added particles contributes still further to image fading.

In direct process printing the liquid developer also picks up ionic contaminants from the recording medium directly. These contaminants also build up with repeated printing applications, additionally fading the prints because they, too, compete with the charged toner particles to respond to the oppositely charged electrostatic image.

Thus there are several factors which contribute to image fading as more and more prints are made. The increased concentration of competing ions and continuously increasing charge level of the colored particles causes image fading which cannot be corrected by adding of concentrate. The only practical solution is to replace and discard the ruined developer. This is expensive and environmentally undesirable.

In U.S. Pat. No. 4,980,259, Landa et al. teach a formula for an amount of charge director, another name for charge agent, to be supplied to a batch of concentrate during manufacture to attempt to maintain a constant charge director level in the developer. This concentrate is then added to a developer liquid, along with a mixture of carrier liquid and charge director, in response a measurement of the overall amount of the developer and a measurement of the concentration of toner particles in the developer. U.S. Pat. No. 5,155,001, also to Landa et al., teaches supplying an excess of a partially soluble charge director compound to a carrier liquid, so that the charge director remains at a saturation concentration in the carrier liquid.

A remaining problem is how the charge director concentration in the developer can be at a low enough level to prevent fading of the printed image while the charge director concentration in the concentrate is high enough to prevent settling and agglomeration of the toner particles.

It is an object of the present invention to provide a printing system that can be operated continuously without discarding developers in bulk due to excess charge agent. It is a further object of this invention to provide a direct process printing system that can be operated continuously without discarding developers in bulk due to an increase of ionic contaminants.

SUMMARY OF THE INVENTION

The present invention provides a system for continuous printing that utilizes a relatively low level of charge agent in the concentrate, while the toner particles in the concentrate are kept from agglomerating by continuously stirring or agitating the concentrate. As a result, the concentration of charge agents in the concentrate can be set as low as the concentration of charge agents that is ideal for the developer. The charge agent concentration then remains constant as the concentrate is added to replenish the developer, allowing the printing system to be operated continuously without bulk disposal and replacement of the developer. Because the concentrate contains a much higher level of colored solids than does the developer, the actual percentage by weight of charge agent in the concentrate is higher than in the developer. This is because the particles carry many charge agent molecules adsorbed onto their surface. The concentration of charge agent which is dissolved in the clear carrier fluid is preferably the same in concentrate and developer. Also, it is preferably a small concentration.

In a first embodiment, the same concentration of charge agent is provided dissolved in thermodynamic equilibrium in the carrier liquid of the concentrate and in the carrier liquid of the developer, that concentration being the one that is best for producing optimum images with the developer. The same concentration of dissolved charge agent is provided in clear carrier liquid. As toner particles, replenishment carrier liquid and charge agent are removed from the developer by printing on the recording medium, charge agent is added to the developer at the correct concentration by replenishment with the carrier liquid and with the concentrate. The relative amounts of carrier liquid and concentrate that are used to replenish the developer are calculated based upon the electrostatic latent image deposited on the medium and the various component amounts likely to be depleted by application of developer to that latent image.

In a second embodiment, the carrier liquid is supplied without charge agent. The developer is supplied as a pre-mix with an ideal concentration of charge agent for producing prints. The concentrate has a slightly higher concentration of dissolved charge agent than the developer. As the carrier and concentrate are added to replenish the developer, the slightly higher concentration of charge agents in the concentrate tends to balance the lack of charge agents in the carrier.

In a third embodiment, there is no pre-mix and the colored particles are supplied only as concentrate which includes charge agent and the supplied carrier liquid contains no charge agent. In this embodiment the printer automatically mixes concentrate and carrier to form developer and carrier and concentrate are added to replenish the colored particles and overall liquid level.

In both the first and the third embodiments, the need for a pre-mixed solution or developer is eliminated, as it is not necessary to wait for the concentration of charge adsorbed onto the toner particles to stabilize and for thermodynamic equilibrium to be reached. Since the concentrate already has an adsorbed charge agent concentration favorable for the development of images by the developer, the concentrate and the carrier can be simultaneously supplied to a liquid pump which mixes the carrier and concentrate to form developer. Also, concentrate and carrier can be added to the developer for replenishment purposes. The elimination of volumes of pre-mix is especially favorable as it yields substantial savings of space, time and money.

For single color direct process printing, a small volume of toner is purified after each application to remove ionic contaminants from the developer acquired during contact of the developer with the recording medium. The purifier removes both ionic contaminants and toner particles by passing the sampled volume of developer through an electric field that causes these particles and ions to accumulate on one surface, from which they are removed, leaving purified carrier. The purified carrier is then added to replenish the developer, along with toner particles in the form of concentrate to replace those lost to purification and the toner particles and carrier lost to the recording medium. The replenishment is accomplished, as above, by controlled injections of calculated amounts of carrier and concentrate. The purified carrier fluid may be mixed, if desired, with new carrier fluid supplied for fluid volume replenishment purposes.

For multiple color direct process printing, the carrier liquid is pumped through an applicator for cleaning purposes after all but a small, controlled residual volume of the developer has been removed from the applicator. An electrophoretic purifier is used, as above, to remove toner particles as well as ionic contaminants received from the recording medium, both of which are present in the carrier as a result of intermixing with the residual volume of developer which is washed out of the applicator by the "cleaning" carrier. A controlled residual volume of carrier liquid is also then left in the applicator after cleaning and this carrier fluid is intermixed and acquired by the next batch of developer provided to the applicator, which compensates for the residual volume of developer which was lost to the applicator during the last usage of that particular developer. Any charge agent dissolved in the "cleaning" carrier fluid passes through the separator essentially unaffected. This is because the dissolved charge agent is almost completely un-ionized in the clear fluid and thus is relatively unaffected by the electric field of the separator. Due to the relatively low or zero concentration of charge agent in the carrier, the addition of carrier fluid to replenish the overall liquid level does not have a deleterious effect on the optimum charge level of the developer.

The present invention can be seen to eliminate both the bulk supply of pre-mixed developer and the bulk discard of contaminated developer. Thus, while prior art printing systems tended to operate in batches of developer that had favorable printing characteristics when supplied and that deteriorated over time to the point that they had to be discarded, the printing system described herein can be operated continuously without noticeable variations in printing quality. The terms "continuously operated" and "continuous printing" should be understood to be limited by the addition of liquid carrier, the addition of small quantities of ink-like concentrate, and the removal and discard of even smaller quantities of ink-like sludge or solid chunks of waste material produced by the separator as a result of carrier purification. The disposal of large quantities of ruined developer is, however, eliminated.

BEST MODE FOR CARRYING OUT THE INVENTION

Figure 1:
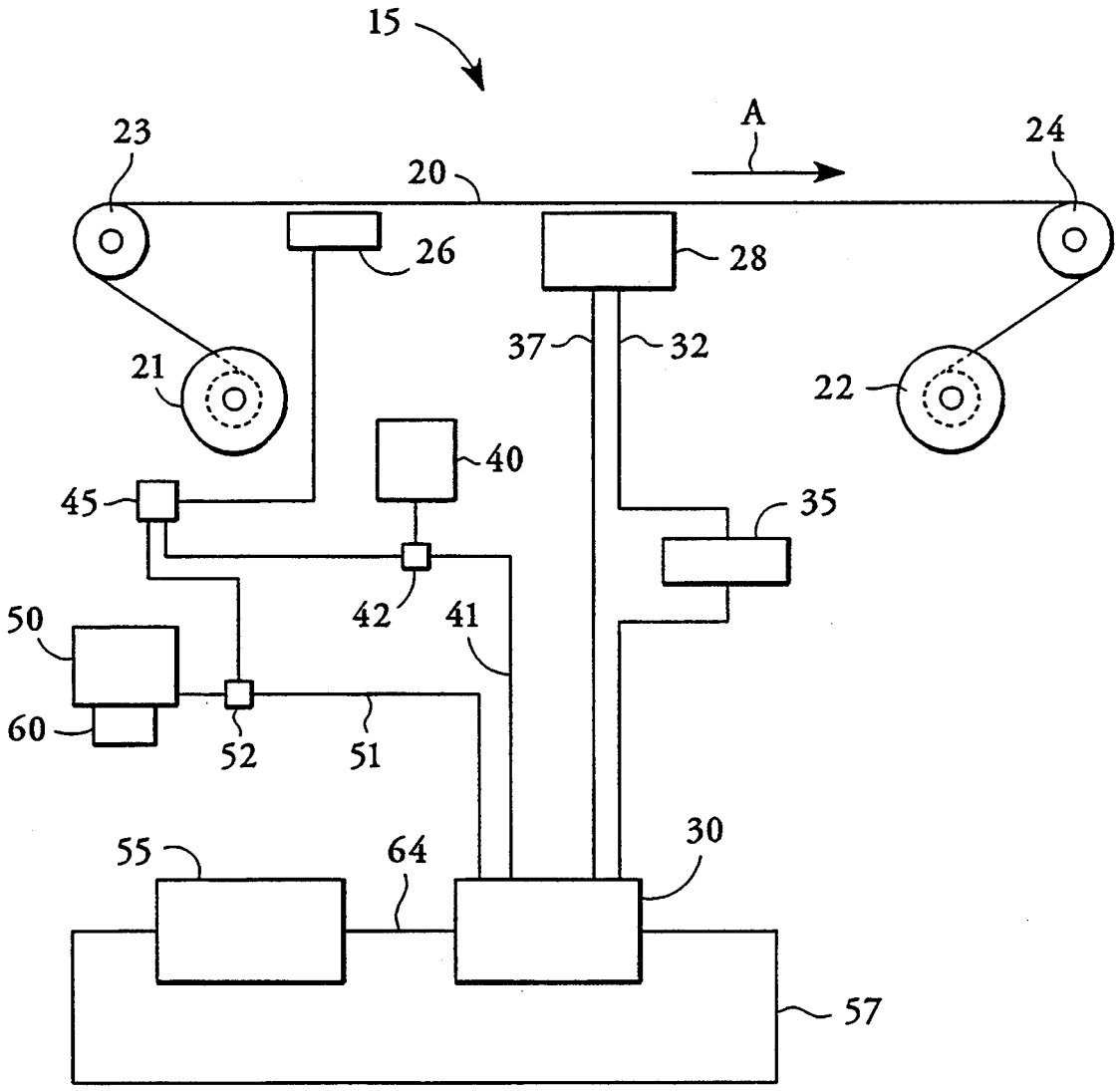
FIG. 1 is a plan view of a single color printing system of the present invention.

Referring now to FIG. 1, a simplified, one color printing system 15 of the present invention is shown in which a recording medium 20 such as a web of paper travels in a direction shown by arrow A. The medium 20 is maintained under tension between a paper supply roller 21 and a paper take-up roller 22, and is precisely positioned with the aid of paper turning idlers 23 and 24. The medium 20 travels first past a writing head 26 and then past a toner applicator 28. The writing head 26 deposits an electrostatic image on a surface of the medium 20, and then the applicator 28 brings liquid developer into contact with the medium 20, causing pigmented, electrically charged toner particles within that developer to migrate to the medium 20 in response to the electrostatic image. This selective migration of charged toner particles to a latent electrostatic image to form a visible image is often called toning.

Although the process described and shown involves a direct process printing system, the present invention can also be used with a transfer process printing system. In a transfer printing system, instead of depositing an electrostatic image directly on a surface of a medium, an electrostatic image is deposited on an intermediary surface, which is toned with developer, and the image residing on that surface is then transferred to a medium.

The developer contains a mixture of carrier liquid, charge agent, pigmented toner particles and stearic stabilizers. The carrier liquid is an electrically insulative, non-polar solvent such as Isopar, into which toner particles and charge agents may be dispersed. The carrier liquid may contain film forming stearic stabilizers that help stabilize the developer and which act to glue an image to the medium in addition to other chemicals that help to assure correct charging of the particles as well as to prevent their precipitation and coalescence into a solid mass or cake.

The charge agents may be metal soaps such as zinc octoate that ionize slightly in the carrier liquid. The toner particles are pigment carrying, resinous particles that attract charge agent molecules to their surface causing further ionization of the charge agents. As a small fraction of the adsorbed charge agent molecules become ionized on the surface of the toner particles, the toner particles acquire an electric charge. The developer has reached an equilibrium state where the number of charge agent molecules adsorbed by the toner particles is in thermodynamic equilibrium with a number of dissolved charge agent molecules in the surrounding carrier fluid. For every ionized charge agent on the particle, there exists a counter ion in solution of opposite polarity. A small concentration of charge agent ions having the same polarity a the toner particles may exist in the carrier liquid along with a larger concentration of charge agent counter-ions having an opposite charge from the toner particles. The great majority of charge agent molecules, both adsorbed and dissolved, remains un-ionized.

Stearic stabilizers are also adsorbed onto the surface of the toner particles. Their function is to provide a coating for the toner particles that hinders the tendency of the toner particles to agglomerate, and to help the toner particles adhere to the medium. The stearic stabilizers, however, may interfere with the adsorption of charge agent by the toner particles.

For high quality printing, it has been found that the concentrations of toner particles and charge agent fall within certain ranges, which are defined as favorable for the formation of an image. A favorable concentration of toner particles within a developer is generally in the range 0.3% to 2.0% of the developer, by weight with the optimum concentration in the range 0.5% to 1.0%. It is understood that satisfactory operation of the printer can be obtained over a range of particle concentrations and precise control of the particle concentration is not necessary. A favorable concentration of charge agent within a developer is 10 to 2000 parts per million (ppm) by weight. A preferred range of charge agent concentration is 100 to 500 ppm. Within these ranges, a higher concentration of charge agent should generally correspond with a higher concentration of toner particles. A toner particle concentration of approximately 0.6% by weight may be ideal. The remainder of the developer is comprised of carrier, which can include small amounts of stearic stabilizers.

Prior art concentrates typically contain a concentration of toner particles of 5% to 10% by weight of the concentrate. The charge agent concentration of these concentrates is typically two to twenty times that in the developer. Thus a charge agent concentration in prior art concentrates is commonly greater than 1000 to 5000 ppm by weight. Due to this high level of charge agent, when such concentrates are added to a developer solution with a much lower charge agent concentration, many deleterious effects as described above may take place. Additionally, a day or more may be required for the charge agent concentration in the developer to equilibrate.

In a first embodiment of the present invention, the dissolved charge agent concentration in the concentrate is the same as dissolved charge agent concentration in the developer and the carrier. Since differing amounts of charge agent may be adsorbed onto particle surfaces, it may be necessary to determine experimentally the amount of charge agent required to be added to produce the desired dissolved concentration. For other preferred charge agents, the optimum dissolved concentration is very low and essentially all of the added charge agent is adsorbed on particle surfaces. In any case it may be necessary to experimentally determine the overall amount of charge agent required to be added to the concentrate so as to produce long term imaging stability when concentrate is added to the developer in order to replenish the particulate solids as they are consumed.

The concentration of toner particles in a preferred concentrate is 10% to 50% by weight. Thus the concentration of toner particles can be much higher while the concentration of dissolved and adsorbed charge agents is much lower than in prior art concentrates, the change in the concentrations made possible by stirring the concentrate to prevent the toner particles from settling and agglomerating into a solid mass or cake. It is advantageous for a concentrate to have a higher concentration of toner particles so that a smaller volume of concentrate can be provided for the same amount of printing. It is advantageous for a concentrate to have a reduced level of charge agent so as to prevent image fading and toner ruination.

In a second embodiment, the charge agent concentration is slightly higher in the concentrate than that in the developer. The carrier is provided without charge agent, so that the charge agent concentration in the concentrate balances with the lack of charge agent in the carrier, to yield a charge agent concentration which is optimum for imaging and image fading is prevented.

The developer is supplied to the applicator 28 from a developer tank 30 via a supply conduit 32 and by means of a pump 35. Excess developer is returned to the developer tank 30 via a return conduit 37. The developer that is returned to the developer tank 30 after an application has lost small amounts of carrier liquid, toner particles and charge agent molecules. On the other hand, the developer that is returned to the developer tank 30 has, at least in direct process printing, typically gained small amounts of ionic contaminants from the recording medium 20.

The developer is initially created by mixing predetermined amounts of concentrate and carrier. The carrier is housed in a carrier tank 40 which has an delivery pipe 41 that connects with the developer tank 30. The amount of carrier flowing from the carrier tank 40 to the developer tank 30 is controlled by a solenoid valve 42 on inlet pipe 41, the solenoid valve 42 in turn being controlled by a programmable processor 45. The concentrate is contained in a concentrate tank 50, which has an inlet pipe 51 leading to the developer tank 30, and which is controlled by a solenoid valve 52, which is also controlled by the processor 45. The concentrate tank is also provided with stirring means 60 more fully described below. The charge of the toner particles in the concentrate is approximately that favorable for developer, obviating the need to wait for the developer mixture to stabilize. The mixing provided by rotary blades in the pump 35 is then sufficient to allow the developer to produce high quality images, without any pre-mixed developer.

Just as the developer of the present invention does not need time to stabilize, neither does that developer need as much space to provide a stable solution for printing. Thus the developer tank 30 of the present invention may be from one quarter to two liters in volume, and preferably approximately one half liter. Compared with typical prior art developer volumes of four to six liters, the present invention offers a considerable savings in developer tank size, therefore allowing smaller printing systems.

The relative amounts of toner particles, charge agents and carrier lost during each printing depends on the image density of the printed image. In other words, images with a higher amount of printed areas will tend to use more toner particles and charge agents, while images with relatively lower amounts of print will use less toner particles and charge agents and somewhat less carrier. The amounts of printed verses non-printed areas are determined by the electrostatic latent image deposited on the medium by the writing head 26. The latent image is in the form of tiny dots or pixels each of which is deposited by an individual nib incorporated in head 26. By simply counting digitally the number of dots laid down for each color, the amount of required concentrated needed can be estimated. This avoids the costly and troublesome need to actually measure the changing concentration of solid particles as they are consumed. The estimated amount of required concentrate is then automatically added by processor 45 by means of valve 52. Similarly, the amount of clear carrier lost can be estimated from the number and average image fraction of the prints produced. Image areas carry out more liquid than do background areas. Alternatively an inexpensive level sensor in developer tank 30 may by used for determining the opening of carrier adding valve 42 so as to maintain the overall liquid level in developer tank 30. The incorporation of the required level of charge agent in the concentrate fluid assures charge optimization over time and usage.

The carrier tank 40 supplies carrier as needed to replenish the carrier lost to the medium 20. The amount of carrier released from the carrier tank 40 to the developer tank 30 for replenishment is controlled by the solenoid valve 42 which in turn is controlled by a signal from the processor 45 that is based on the electrical charge deposited on the medium 20 by the writing head 26 and on the total area of prints made. The concentrate tank 50 also releases small amounts of concentrate into the developer tank 30 as determined by the processor 45 controlling a solenoid valve 52. The processor 45 can be programmed to release different amounts of carrier and concentrate for a given amount of charge deposited by the writing head 26 and area of prints produced, allowing fine tuning of the replenishment process by the user. Different types of media from different media suppliers and different toner/concentrate sets from different toner suppliers may require such fine tuning so as to adapt to different materials desired by the user. It should be understood that various combinations of pumps, injection pumps, valves, plumbing arrangements and the like may be employed without departing from the spirit and scope of this invention.

The ionic contaminants picked up from the media 20 by the developer in direct process printing tend to compete with the toner particles in responding to and neutralizing an electrostatic image. An increased level of ionic contaminants therefore leads to faded images, as fewer toner particles respond to the electrostatic image and adhere to the medium 20, eventually necessitating replacement of the developer. A solution to the problem of build-up of ionic contaminants is offered in copending U.S. patent application Ser. No. 07/973,837, entitled, "CONTINUOUS PURIFICATION OF LIQUID TONERS", which is hereby incorporated by reference herein. That application describes a system that continuously samples and purifies a small volume of developer or carrier to remove ionic contaminants and toner particles, and reintroduces the resulting purified carrier into the printing system.

As applied to the printing system of the present invention, for direct process printing systems a small volume of toner is sampled from the developer tank 30 with each application of developer to the medium 20 and fed into a purifier 55 via a conduit 57. The purifier includes an electrophoretic separator that has an electrically charged surface which attracts oppositely charged ions and particles. The ionic contaminants and toner particles present in the sample are accumulated on surface of the separator and scraped off as sludge or as solid chunks, leaving purified carrier, which is returned to the developer tank 30 via conduit 64. In an alternative embodiment, not shown, the purified carrier can be returned to the carrier tank 40 rather than the developer tank. The purifier 55 tends to remove toner particles and ionic contaminants from the developer much more than charge agents, leaving the charge agent concentration essentially unchanged after purification.

The processor 45 is programmed to compensate for the toner particles lost from the developer if the purified carrier is returned to the developer tank 30, or for the toner particles and carrier that are lost from the developer if the purified carrier is returned to the carrier tank 40. The processor 45 controls the opening of the solenoid valves 42 and 52 to inject a correct amount of carrier and concentrate to replenish the developer lost to the medium 20 and the purifier 55.

In the first embodiment described above, the developer, the carrier and the concentrate all contain the same concentration level of dissolved charge agent, which is determined by an ideal level of charge agent in the developer for optimum print quality. As the concentrate and carrier replenish and gradually replace the developer over time, the charge agent level remains substantially constant. Having a dissolved charge agent level in a concentrate that is equal to an ideal level for a developer would, however, normally result in the toner particles in the concentrate settling and agglomerating into a solid mass or cake. This tendency to agglomerate is due to gravitational settling of particles when the charge agent concentration is reduced below the prior art.

In order to prevent such agglomeration and maintain an homogenous dispersion of the toner particles, the concentrate in tank 50 is continuously or periodically stirred by a stirring means 60. A preferred stirring means 60 is the combination of a small, magnetically susceptible object, such as a magnetic metal bar made of iron or the like disposed within the concentrate tank 50, and a magnetic field source such as a rotating permanent magnet disposed adjacent to the tank 50 and in motion relative to the tank 50. Such "stir bars" are common commercially available chemical mixing devices. As the magnetic field permeating the concentrate tank 50 revolves, the metal bar within the concentrate tank 50 spins in reaction to the field, mixing the concentrate. During printing the concentrate is continuously stirred. When the system is not printing, the concentrate is periodically stirred. That is, it is stirred for about one minute after fourteen minutes without stirring, which is sufficient to prevent agglomeration. Alternatively, the concentrate tank may be movably mounted on a pivot or the like so that periodic or continuous rocking of the entire tank can serve to keep the particles in suspension.

Figure 2:
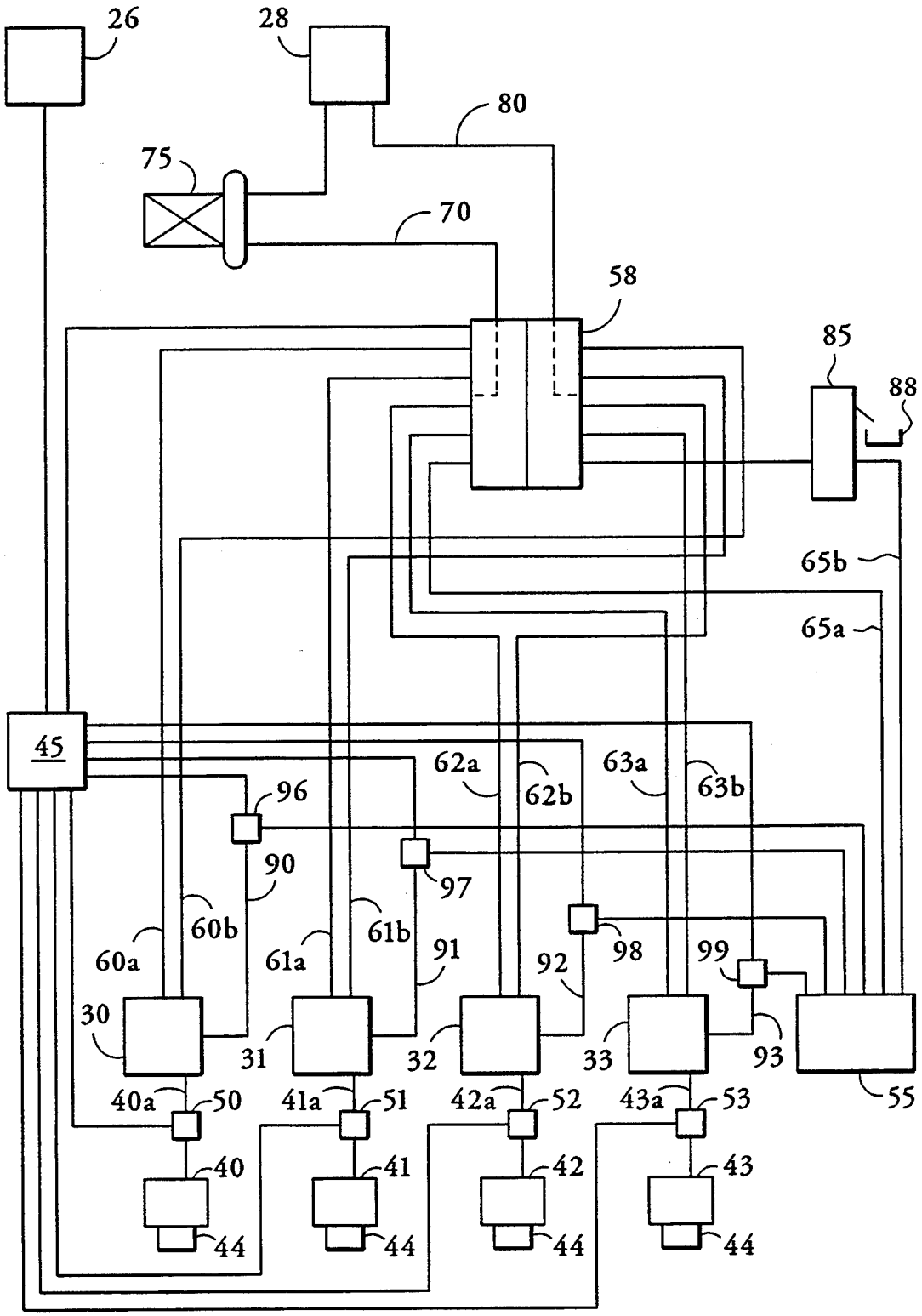
FIG. 2 is a plan view of a multi-color printing system of the present invention.

With reference to FIG. 2, color printing requires a plurality of developer tanks. Printing occurs during a series of passes of the medium, not shown, past the writing head 26 and the applicator 28, with a single developer color being deposited with each pass. Developer tank 30 contains black developer, developer tank 31 contains cyan developer, developer tank 32 contains magenta developer and developer tank 33 contains yellow developer. Associated with each development tank is a concentrate tank. Thus, tank 40 houses black concentrate, tank 41 houses cyan concentrate, tank 42 houses magenta concentrate and tank 43 houses yellow concentrate. A conduit connects each developer tank 30–33 with its respective concentrate supply tank 40–43. Conduit **40*a* connects tanks 30 and 40, conduit 41*a* connects tanks 31 and 41, conduit 42*a* connects tanks 32 and 42 and conduit 43*a* connects tanks 33 and 43**.

Associated with each concentrate tank 40–43 is a mixing means 44 for keeping the concentrate in each tank in an homogenous suspension. It is due to these mixing means 44 that the concentrates are able to be kept in suspension yet have a sufficiently low charge agent concentration to allow the developer to be continuously replenished without being discarded. Alternatively, all four concentrate tanks may be mounted on a single "rocking" rack so that all concentrate tanks are agitated using only a single mechanism.

A processor 45 uses information regarding the electrostatic charge deposited by the writing head 26 to form a latent image for each color of developer in order to calculate an amount of concentrate needed to replenish that developer. Solenoid valves 50–53 controlled by the processor 45 and located on each conduit **40*a*–43*a* allows an amount of concentrate necessary to replenish each developer to flow from each concentrate tank 40–43 to its respective developer tank 30–33. This electronic determination of the concentrate needed to replenish the various developers with a single processor 45 offers cost efficiencies over systems requiring separate optical sensors sampling each developer tank in order to determine replenishment amounts. Alternatively, injection pumps which are well known in the art may be used to inject known quantities of concentrate into the developer tanks 30–33** or into lines leading to or from the developer tanks.

After each developer color has been supplied to the applicator 28, the applicator is washed with carrier liquid supplied from a carrier tank 55. Each developer tank 30–33 and the carrier tank 55 has a supply conduit leading to a common selector valve 58. Similarly, a drain conduit leads from the common selector valve 58 to each developer tank 30–33 and carrier tank 55. Conduit 60*a* is a supply conduit and conduit 60*b* is a drain conduit, both of which connect tank 30 to common selector valve 58. Similarly, conduits 61*a* and 61*b* are, respectively, supply and drain conduits for tank 31, conduits 62*a* and 62*b* are respective supply and drain conduits for tank 32, conduits 63*a* and 63*b* are respective supply and drain conduits for tank 33, and conduits 65*a* and 65*b* are respective supply and drain conduits for tank 55.

A common supply pipe 70 provides the developer or carrier liquid chosen by the common selector valve 58 to the applicator 28 via a pump 75. Common selector valve 58 may be controlled by processor 45. Following each application of developer, the developer is drained from the applicator 28 through a common drain pipe 80 to the common selector valve 58, which directs the developer back to the developer tank 30–33 from whence it came. At the end of a color pass all but a residual volume of developer is drained or purged with air from the applicator 28. The common selector valve 58 then directs carrier to the applicator 28 from the carrier tank 55, by means of selector block 58 and liquid pump 75. The carrier thus rinses the applicator 28, pump 75 and common pipes 70 and 80 of each color of developer before the next color of developer is pumped to the applicator 28. This rinsing process introduces minor amounts of colored toner particles, charge director and ionic contamination into the carrier fluid stream.

A controlled residual volume of developer is left in the applicator 28, pump 75 and common pipes 70 and 80 and is thus assimilated by the carrier liquid as it rinses out the applicator and pump 75 and pipes 70 and 80. The carrier liquid is passed through a purifier 85 before returning to the carrier tank via drain conduit 65*b*. The purifier, as described above, removes ionic contaminants acquired by the preceding developer along with toner particles of the previous developer, both of which have been mixed into the carrier from the residual volume of developer. The resultant purified carrier is returned to carrier tank 55 via drain conduit 65*b*, while the toner particles and ionic contaminants are scraped off as concentrated sludge or chunks and collected in waste tray 88 for removal.

Each time the applicator 28 is flushed with carrier a residual volume of carrier is left in the applicator 28, pump 75 and common pipes 70 and 80. This clean carrier fluid is then mixed in with the developer next supplied to the applicator, making up for the residual volume of developer which was lost the last time that developer was used. Thus it may be seen that every time a colored developer is selected a small quantity, typically 4 milliliters, of clear carrier is mixed in with the developer at the beginning of a color toning pass. At the end of that toning pass a substantially equal amount of developer is left behind in applicator 28. The net effect is a minor loss of colored particles and charge director along with any stearic stabilizers that may be in the developer. Also left behind is a small amount of ionic impurities which contaminate the developer. Addition of concentrate automatically replenishes the colored particles, charge director and stearic stabilizer. To make up for clear fluid carried out on the recording medium, clear carrier fluid may be supplied by operating appropriate valve 96–99.

Similarly, the residual volume of carrier lost from carrier tank 55 is compensated for by the residual amount of developer gained by the carrier after passing through purifier 85. Alternatively, a slightly greater residual volume of carrier than developer may be left in the applicator 28, to make up for the carrier lost from the developer to the recording medium. When the amount of clear carrier in tank 55 drops below a predetermined limit, processor 45 causes an audible or visual warning indication to the user so that the user may know when to add carrier fluid to the printer. This "low carrier" warning may be computed by processor 45 from the number and nature of prints made or it may be indicated by a sensor within carrier tank 55. The toner and/or carrier residual volumes in applicator 28 may be controlled by the time allowed for the carrier to air purge or drain from the applicator 28. These residual volumes may be programmable for the convenience and benefit of the user.

The principle losses of this system are the developer (including carrier, toner particles, charge agents and stearic stabilizer) that is lost to the recording medium, and the toner particles, adsorbed charge agent and stearic stabilizer that are lost to the purifier. A very small amount of liquid carrier is also lost to the waste sludge or chunks produced by the purifier. The carrier in the developer that is lost to the recording medium may be replenished by a controlled excess amount of residual carrier left in the applicator 28. The toner particles and charge agent lost is replenished by a controlled addition of concentrate from the concentrate tanks 40–43 to the respective developer tanks 30–33, this addition being controlled by the solenoid valves 50–53.

Alternatively, the additional amounts of carrier needed to replenish the various developers can be supplied via conduits 90–93 leading from carrier tank 55 to developer tanks 30–33, the supply of carrier to each developer tank being determined by the processor 45 controlling solenoid valves 96–99. Thus, solenoid valve 96 controls conduit 90 leading from carrier tank 55 to developer tank 30, solenoid valve 97 controls conduit 91 leading from carrier tank 55 to developer tank 31, solenoid valve 98 controls conduit 92 leading from carrier tank 55 to developer tank 32 and solenoid valve 99 controls conduit 93 leading from carrier tank 55 to developer tank 33.

As previously discussed, in direct process printing ionic contaminants from the recording medium are acquired by the developer during contact with the medium. In order for such a color printing system to run continuously without discard of the developers a sufficient amount of ionic contamination must be removed to keep ionic contaminants from building up to a damaging degree. Removal of a sufficient amount of ionic contaminants to allow continuous operation requires that a sufficient amount of such contaminants is left in the residual volumes of developer, such amount being subsequently assimilated by the carrier for purification. It has been found that residual volumes of developer of about 3 milliliters or higher enable sufficient purification to avoid excessive ionic buildup. Larger residual volumes of developer allow greater purification, but cause more sludge to be produced and require more concentrate to be added. Typically, residual volumes of about 4 milliliters may be employed to assure continuous printing.

In the first embodiment, the concentration of dissolved charge agent in the carrier is equal to the concentration of dissolved charge agent in the developer and the concentration of dissolved charge agent in the concentrate. Normally, all charge agent in the carrier is dissolved whereas in the concentrate and in the developer, a portion of the charge agent is in the form of adsorbed molecules attached to the surface of the colored particles. Depending on the particular toner manufacturer and the specific toner formulations employed, the greater portion of the charge director may be adsorbed on particle surfaces rather than dissolved. U.S. Pat. No. 5,045,425, for example, teaches a method of colored toner manufacture in which virtually all of the "charge director" is associated with, that is adsorbed onto the surface of particles. This class of toner formulation is preferred for the instant invention although it is not necessary in order to practice the invention. If most of the charge agent is adsorbed onto particles there is very little in the clear phase in solution in which case the carrier may be provided entirely without charge director. This is preferred but not required for the instant invention. Current suppliers of commercial colored liquid toners include Hilord Chemical Corporation, Hauppauge N.Y. and Specialty Toner Corporation, Fairfield N.J.

Thus, if the fraction of total charge agent in a developer which is adsorbed on particles is large, typically above 90 percent, or if the concentration of charge agent in solution in the concentrate, developer and carrier is substantially the same, the level of charge agent in the developer remains effectively constant as the developer is replenished with carrier and concentrate. This constant concentration of charge agent is at a level favorable for the production of high quality prints and color quality is maintained with usage. It is generally preferred to employ toner formulations in which the fraction of adsorbed charge agent is large but the instant invention is effective in maintaining print quality with any known toner formulation.

As discussed above for a single color printer, this embodiment allows much smaller developer tanks 30–33 to be employed than those typical of the prior art. This is because the prior art development tanks were larger than necessary, in order to offer a more stable developer. The undesirable build-up of excess charge agent and ionic contamination is slowed if the developer tanks are large simply because of dilution effects. Although these larger than necessary tanks have delayed toner change-out intervals in the prior art, they have increased the amount of toner discarded per change-out. Effectively, prior art methods ruin toner at a rate independent of tank size. Typically, prior art developer tanks have been 4 to 7 liters. With the instant invention developer tanks may conveniently be 0.5 to 2 liters in size.

For example, if prior art concentrate with levels of charge agent two to ten times higher than that of the developer were added to replenish the developer, that added concentrate would require a substantial length of time before it reached an equilibrium with the rest of the developer. For this reason, large prior art developer tanks offered stability through size, which masked the influx of disparate solutions. Without this need for stability through size, the developer tanks can be smaller, allowing the whole printing system to be reduced in size and made more economical and convenient.

In the second embodiment, no charge agent is present in the carrier and the level of charge agent in the concentrate is slightly above the level most favorable for the developer to produce high quality visible images. As the concentrate and carrier are added to replenish the developer, the excess charge agent in the concentrate tends to balance the lack of charge agent in the carrier, resulting in a charge agent level in the developer that is that most favorable for image development. For toner formulations in which almost all of the charge director is in adsorbed form, as in U.S. Pat. No. 5,045,425 to Swidler, the amount of dissolved charge director may be neglected and no charge director need be included in the carrier fluid. In this case, the amount of charge director supplied by the manufacturer is in direct proportion to the amount of particles in the concentrate. Optimally effective developers may be made either manually or automatically simply by adding an appropriate amount of such concentrate to pure carrier. For example, 12 milliliters of concentrate containing 25 percent colored solids might be mixed with 488 milliliters of pure carrier such as isopar to make 0.5 liters of toner having 0.6 percent solids. Such toners having very little or no dissolved charge agent have the additional benefit of rapid thermodynamic equilibration. When such concentrate is added to a developer tank the amount of charge agent which can be lost to the clear carrier phase is negligible and no transient color changes are noticed. It should be clearly understood, however, that the benefits of the present invention extend equally to all liquid toner formulations.

Figure 3:
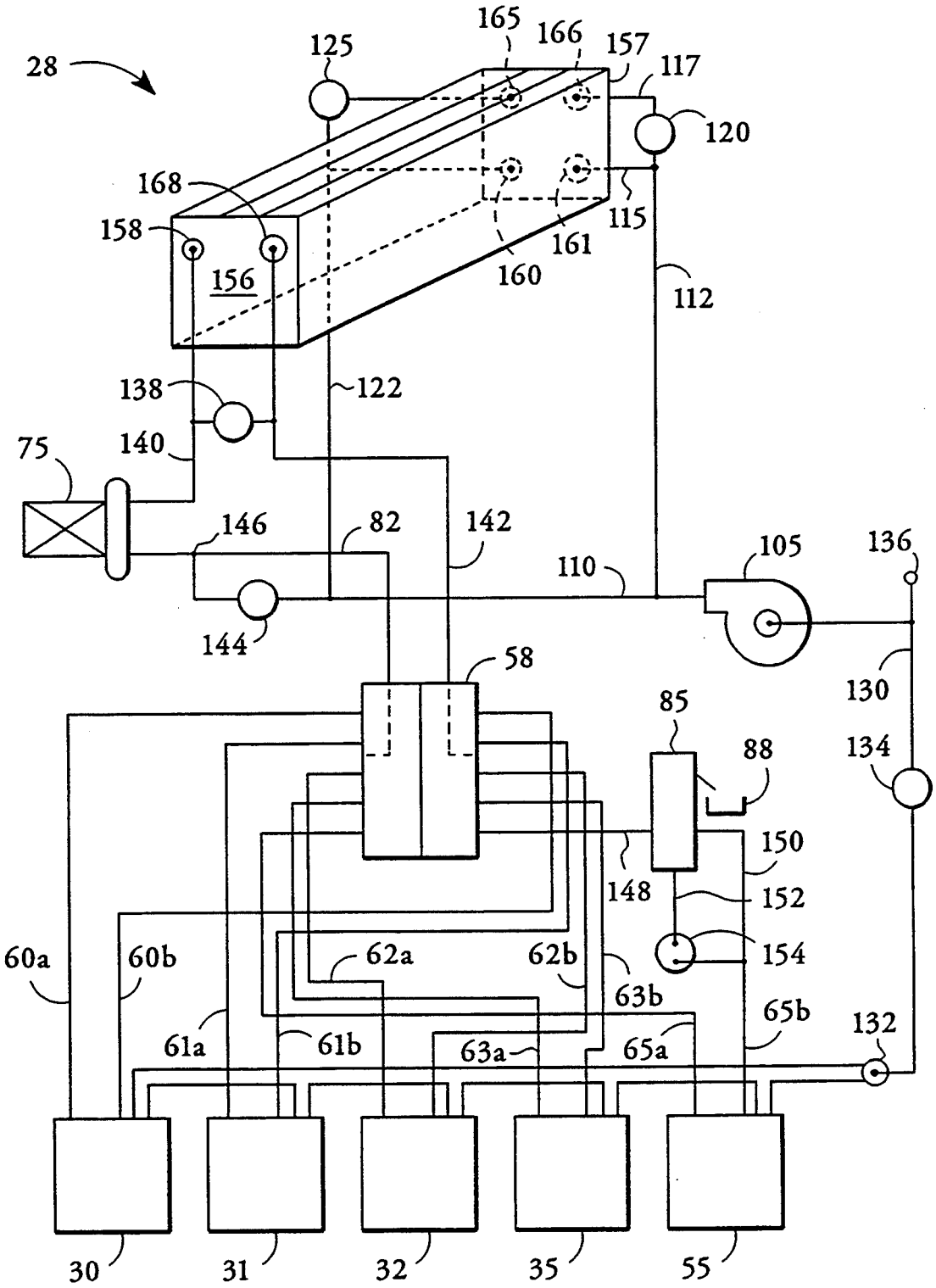
FIG. 3 is a plan view of the printing system of FIG. 2 including a system of pressurized air.

Referring now to FIG. 3, an optional, but preferred, high velocity air supply means, such as blower 105 provides a more efficient means of purging developer conduits than the pump 75 alone. To facilitate illustration, the writing head, processor, solenoid valves, concentrate tanks, stirring means and connections therebetween have been excluded from this drawing, it being understood that they are included although not shown.

An air jet in a conduit 110 of large inside diameter, approximately five-eighths inch, joins the air supply means to the input of liquid pump 75 through valve 144. Air blower 105 is preferably an RDC Revaflow Blower Model RDC12HH, manufactured by EG&G Rotron; Saugerties, N.Y. Another conduit 112, similar to conduit 110, is connected from the air supply means 105 to the applicator 28 through first and second conduit branches 115 and 117. Second branch 117 includes air valve 120 which is opened for air jet purging of applicator 28. Another air conduit 122 connects conduit 110 to applicator 28 through air valve 125 which is used for air jet purging of a different part of applicator 28. Air valves 120 and 125 are thus opened in order to thoroughly purge and expel liquid from separate internal passages of applicator 28. Air valves 120 and 125 may be opened for air jet purging simultaneously or they may be opened sequentially. Sequential opening provides maximum air flow through a selected internal passage of applicator 28.

Air return line 130 connects the input of air supply means 105 to common air collection manifold 132 through air valve 134. Developer drain conduits 60*b*, 61*b*, 62*b* and 63*b* and carrier drain conduit 65*b* carry a mixture of liquid and air to selected tank 30, 31, 32, 33, or 55 from selector valve 58. The selected tank serves as a separator so that the air rises to the top of the tank and the liquid falls to the bottom. Common air manifold 132 causes a slight air pressure reduction above the liquid of all five tanks as air is drawn by air supply means 105 through conduit 130 connected to common air return manifold 132. In this way the air which has been separated by rising to the top of a tank is returned and recirculated through applicator 28 and pressure build-up in the tank is prevented. First valve 134 is positioned in air return line 130 and is kept open during both the toning and purging operations. Valve 134 is closed only temporarily when loading paper onto a drum or take-up spool before writing or toning begins. By closing valve 134 the suction of air supply means creates a partial vacuum at port 136 which is connected by means not shown to a drum or take-up spool also not shown.

A fourth air valve 138 is positioned to short circuit the hose supply line 140 to the hose return line 142 in order to provide a low resistance return path for purged fluids without passing through the liquid pump 75 which would restrict the high velocity flow. This short circuit path also permits the liquid pump to remain running during fluid purging so that residual liquid within liquid pump 75 is purged and returned to selector valve 58 through open valve 138. At the same time, opening fifth air valve 144 provides high velocity air at connection point 146 for forward purging of the running liquid pump 75 through valve 138. Opening fifth valve 144 also provides high velocity purge air for reverse purging of the liquid supply line 82 connecting an input 146 of liquid pump 75 to selector valve 58. The selector valve 58 connects with selected toner supply line 60*a*, 61*a*, 62*a*, 63*a* or with carrier supply conduit 65*a*. In this way the selected liquid supply line, the selector valve 58, the liquid pump input line 82, the liquid pump 75, the applicator drain line 142 and the applicator 28 itself are all effectively purged of liquid. Air valve 120 and air valve 125 are opened as described above to supply purging air to the applicator 28, except that a small volume of liquid is left behind.

A first small volume, approximately 4 cc, of spent developer is left in the applicator prior to the introduction of carrier. As carrier is introduced into common volumes including the applicator 28, the spent developer is mixed into the carrier which is then purified in purifier 85, and the purified carrier is sent to the carrier tank 55. A similar second volume of carrier, about 4 cc, is left in the applicator 28 when the wash cycle is complete. As developer is introduced, the second volume of carrier is mixed into the developer causing minor dilution thereof. This shifting of spent toner and clean wash fluid balances volumes so that neither the toner tank nor the wash fluid tank accumulate excess fluid volume. This procedure is discussed below.

A mixture of air and wash fluid is carried to purifier 85 through hose 148 from valve 58. A tank, not shown, separates the air and the carrier from each other. The air is then carried through hose 150 to conduit 65*b* and to the carrier tank 55. Within purifier 85 the wash fluid is separated into purified carrier fluid and sludge or solid chunks which contain the colored toner particles, ionic contaminants and a minor amount of carrier fluid. The purified carrier is carried through line 152 to return line 65*b* and to carrier tank 55. The sludge falls into sludge tray 88 for periodic disposal. Carrier return line 152 may include a filter cartridge 154 which serves to remove paper fibers or other debris from the carrier fluid. Cartridge 154 may be replaced periodically during system maintenance.

A full-width applicator 28 may be seen to have an elongated structure with a first end 156 and a second end 157. Fresh developer enters applicator 28 via entry port 158 at end 156 and travels across the full width of the applicator via an internal cross-channel, not shown, which is connected to port 158. A longitudinal slit delivers the fresh toner to the upper face of the applicator where it tends to spread out and contact the latent image bearing paper web. At the same time air is delivered to the applicator 28 via entry ports 160 and 161 where the air serves to prevent leakage of liquid toner around the upper edges of the applicator as well as to remove by means of an air knife, not shown, the excess liquid from the paper web. The air ports 160 and 161 always supply air to the applicator in contrast to ports 165 and 166 which deliver air to the applicator only when valves 120 and 125 are opened for liquid purging. Valve 138 is opened if either valve 120 or 125 (or both) is opened. The result is that most liquids are driven by the air jet to the left and out of the applicator and, via return line 142 back to the selector valve 58 from where they are returned to the corresponding liquid tank. An exception is a small volume of liquid left in the applicator at the end of a cycle, discussed below. Gravity then separates the liquid from the air within the tank 30, 31, 32, 33, or 55 so that the air may return to the air supply means via the common manifold 132, open valve 134 and air return line 130. There is always an abundant supply of air which is adequate to supply several needs simultaneously although separate opening of the air valves 120 and 125 will allow somewhat more thorough liquid purging of the internal channels of the applicator.

Port 168 at the left end 156 of the applicator 28 serves as a drain means during toning while purging valves 120 and 125 are closed. A mixture of air and used developer from the air knife, which is disposed along an upper edge of the applicator 28, is delivered to port 168 and thence to return line 142, selector valve 58 and then to the corresponding liquid tank wherein the liquid is stored and the air separated for recirculation as described above.

The longitudinal channels in the applicator which are connected to ports 160 and 161 remain dry and free of liquids at all times so long as air pressure is supplied via these ports while the liquid pump 75 is running. Provided the air supply means 105 is started before starting the liquid pump 75 and allowed to operate until a short time after the liquid pump 75 is shut down, the channels connected to ports 160 and 161 will remain in a dry state and not require liquid purging.

Developer in the developer supply channel connected to port 158 will be blown during purging, i.e. when valves 138 and 125 are open, backwards in the direction opposed to its normal flow via open valve 138 into return line 142. At the same time valve 144 is opened thus supplying abundant jet air to supply line 82 at junction 146. From junction 146 the air moves both left and right, i.e. in the normal developer flow direction to the left and opposed to normal developer flow to the right. To the left the jet air assists in purging all liquid from the still running liquid pump 75 and, via open valve 138 the air assists the return of this purged liquid to return line 142 and back via selector valve block 58 to the correct supply tank. Jet driven air moves from junction 146 in opposition to the normal developer flow direction and pushes the liquid backward through the supply line 82 to the selector valve 58 to a selected liquid supply line 60*a*, 61*a*, 62*a*, 63*a*, or 65*a* backwards to the correct tank.

During liquid purging a mixture of air and liquid enters the selected tank through both the selected toner supply line and the selected return line 60*b*, 61*b*, 62*b*, 63*b* or 65*b*. Thus all purged fluids will wind up in the corresponding liquid tank via selector valve 58 whether they return via the corresponding supply line or the air/liquid return line. By this arrangement of valves and lines, the common volume is air jet purged so as to minimize toner fluid mixing and allow a single full-width applicator to be used for all colors. By controlling the air jet purging time a desired small amount of liquid can be left in the common volume.

For direct process printing systems a small volume of spent developer and contaminants is left in the applicator 28. The volume is about 4 cc. This volume is sent to purifier 85 through selector valve 58 when carrier is pumped into the applicator 28. After purification, wherein charged solids and contaminants are removed, the remaining fluid is returned to the carrier tank 55. Rinsing of the applicator 28 is done when the selector valve 58 is actuated so as to select carrier and the air valves 120, 125, 138 and 144 are closed allowing the pump to draw carrier from carrier tank 55 via carrier supply line 65*a*, selector valve block 58, and liquid supply line 82 to liquid pump 75. From pump 75 the carrier is forced by pressure through the same paths as was the preceding toner during toning of the latent image. The carrier picks up and mixes with the small amount of residual developer and contaminants remaining after air jet purging and returns the colored particles and contaminants via drain line 142, selector valve 58, and carrier drain line 148 to the purifier 85.

With liquid pump 75 and air supply means 105 still running, clean carrier is purged from the entire common volume by opening valves 120, 125, 138 and 144 as described above and returning carrier to the carrier tank 55 via selector valve block 58, carrier drain line 148, purifier 85, purified carrier drain line 152 and carrier return line 65*b*. A small amount of clean carrier is left in the common volume by controlling the carrier purging time. This small volume, typically 4 cc, is made to be essentially equal to the volume of developer which was left in the common volume after toner purging. This small volume of clean carrier is automatically mixed with the next developer upon its introduction into the common volume where it acts, on the average, to replace the residual volume of developer which was lost when that developer was last used. Each wash cycle then causes about 4 cc of clean carrier to be transferred from the carrier tank 55 to a developer tank whereas each toning pass results in about 4 cc of developer being transferred from that developer tank to the carrier tank. The fluid volumes thus stay in balance so that no tank becomes overfilled.

The toner particles lost to purification and to form the visible image are replaced by controlled injections of concentrates from tanks 40–43 of FIG. 2 into their corresponding developer tanks 30–33. Similarly, controlled injections of carrier into developer tanks 30–33 can replace carrier lost to the recording medium, or a slightly larger residual volume of carrier than developer can be left for assimilation by the developers.

Thus, the deliberate stirring of concentrate in accord with the present invention allows liquid developer to be created directly from concentrate and carrier rather than supplied as a pre-mix. This concentrate mixing allows a liquid developer printing system, in concert with the above described continuous purification for a direct process system, to be operated continuously without the need for disposal in bulk of large volumes of liquid developer.

The only inputs necessary for such a system, aside from electricity and a recording medium such as paper to print on, are a relatively innocuous clear fluid carrier, such as isopar, and small amounts of ink-like concentrates. The only outputs, aside from paper printed with a desired image, are small amounts of ink-like sludge or colored chunks of waste. For transfer process printing, even that small amount of sludge or colored chunks may be non-existent.

I claim:

1. A continuously operable developing system for electrostatic printing comprising:

a liquid concentrate including toner particles and charge agent disposed within a concentrate tank, a stirring means disposed within said concentrate tank for homogenizing said concentrate, a means for supplying a liquid carrier to a location proximate to said concentrate, a means for combining said carrier and said concentrate to form a developer, a means for forming an electrostatic latent image on a medium proximate to said developer, a means for supplying said developer to said medium, such that said toner particles are attracted to said electrostatic image on said medium in order to form a visible image on said medium, and a means for discharging said developer from said surface to a developer tank.

2. The printing system of claim 1 further comprising a means for purifying said developer.

3. The printing system of claim 2 wherein said means for purifying said developer includes a means for removing ionic contaminants from said developer.

4. The printing system of claim 1 wherein said means for combining said carrier and said concentrate to form a developer includes a pump, said pump supplying said developer to said medium.

5. A continuously operable developing system for electrostatic printing comprising:

a liquid concentrate including toner particles and charge agent disposed within a concentrate tank, a stirring means disposed within said concentrate tank for homogenizing said concentrate, a means for supplying a liquid carrier to a location proximate to said concentrate, a means for combining said carrier and said concentrate to form a developer, a means for forming an electrostatic latent image on a surface proximate to said developer, a means for supplying said developer to said surface, such that said toner particles are attracted to said electrostatic image on said surface in order to form a visible image on a medium, a means for discharging said developer from said surface to a developer tank, and a means for replenishing said developer with said concentrate and said carrier, whereby toning particles, charge agent and carrier transferred from said developer to said medium are replaced.

6. A continuously operable developing system for electrostatic printing comprising:

a liquid concentrate including toner particles and charge agent disposed within a concentrate tank, a stirring means disposed within said concentrate tank for homogenizing said concentrate, a means for supplying a liquid carrier to a location proximate to said concentrate, a means for combining said carrier and said concentrate to form a developer, said concentrate and said carrier having dissolved charge agent concentrations approximately equal to a dissolved charge agent concentration of said developer, a means for forming an electrostatic latent image on a surface proximate to said developer, a means for supplying said developer to said surface, such that said toner particles are attracted to said electrostatic image on said surface in order to form a visible image on a medium, and a means for discharging said developer from said surface to a developer tank.

7. A continuously operable developing system for electrostatic printing comprising:

a liquid concentrate including toner particles and charge agent disposed within a concentrate tank, a stirring means disposed within said concentrate tank for homogenizing said concentrate, a means for supplying a liquid carrier to a location proximate to said concentrate, a means for combining said carrier and said concentrate to form a developer, said concentrate having a dissolved charge agent concentration above that of said developer, and said carrier having a charge agent concentration below that of said developer, a means for forming an electrostatic latent image on a surface proximate to said developer, a means for supplying said developer to said surface, such that said toner particles are attracted to said electrostatic image on said surface in order to form a visible image on a medium, and a means for discharging said developer from said surface to a developer tank.

8. A continuously operable developing system for electrostatic printing comprising:

a liquid concentrate including toner particles and charge agent disposed within a concentrate tank, a stirring means disposed within said concentrate tank for homogenizing said concentrate, a means for supplying a liquid carrier to a location proximate to said concentrate, a means for combining said carrier and said concentrate to form a developer, a means for forming an electrostatic latent image on a surface proximate to said developer, a means for supplying said developer to said surface, such that said toner particles are attracted to said electrostatic image on said surface in order to form a visible image on a medium, a means for discharging said developer from said surface to a developer tank, and a means for replenishing said developer with said concentrate and said carrier, including a means for determining an amount of toner particles and a quantity of carrier transferred from said developer to said medium during formation of said image, and a means for adding said concentrate and said carrier to said developer in response to said amount of toner particles and said quantity of carrier transferred from said developer to said medium during formation of said image.

9. A method for continuous printing comprising:

providing a liquid concentrate having toner particles and charge agent, stirring said concentrate such that said concentrate is homogenized, providing a liquid carrier, combining said concentrate and said carrier to form a liquid developer, forming an electrostatic latent image on a recording medium, and supplying an amount of said developer to an applicator adjacent to said medium sufficient to tone said image on said medium.

10. A method for continuous printing comprising:

providing a liquid concentrate having toner particles and charge agent, stirring said concentrate such that said concentrate is homogenized, providing a liquid carrier, combining said concentrate and said carrier to form a liquid developer, supplying an amount of said developer to an applicator adjoining a recording medium sufficient to tone an image on said medium, and replenishing said developer with amounts of said concentrate and said carrier in response to portions of toner particles, carrier and charge agent transferred from said developer to said medium.

11. A method for continuous printing comprising:

providing a liquid concentrate having toner particles and charge agent, stirring said concentrate such that said concentrate is homogenized, providing a liquid carrier, combining said concentrate and said carrier to form a liquid developer, and supplying an amount of said developer to an applicator adjoining a recording medium sufficient to tone an image on said medium, wherein providing a liquid concentrate having toner particles and charge agent includes combining relative amounts of toner particles and charge agent to imbue said concentrate with a dissolved concentration of charge agent approximately equal to a dissolved concentration of charge agent in said developer.

12. A method for continuous printing comprising:

providing a liquid concentrate having toner particles and charge agent, including combining relative amounts of toner particles and charge agent to imbue said concentrate with a dissolved concentration of charge agent above that of said developer, stirring said concentrate such that said concentrate is homogenized, providing a liquid carrier, including forming a carrier with a dissolved concentration of charge agent below that of said developer, combining said concentrate and said carrier to form a liquid developer, and supplying an amount of said developer to an applicator adjoining a recording medium sufficient to tone an image on said medium.

13. A method for continuous printing comprising:

providing a liquid concentrate having toner particles and charge agent, stirring said concentrate such that said concentrate is homogenized, providing a liquid carrier, combining said concentrate and said carrier to form a liquid developer, supplying an amount of said developer to an applicator adjoining a recording medium sufficient to tone an image on said medium, and purifying said developer.

14. A method for continuous printing comprising:

providing a liquid concentrate having toner particles and charge agent, stirring said concentrate such that said concentrate is homogenized, providing a liquid carrier, combining said concentrate and said carrier to form a liquid developer, supplying an amount of said developer to an applicator adjoining a recording medium sufficient to tone an image on said medium, and removing ionic contaminants and toner particles from a sample of said developer.

15. A method for continuous printing comprising:

providing a liquid concentrate having toner particles and charge agent, stirring said concentrate such that said concentrate is homogenized, providing a liquid carrier, combining said concentrate and said carrier to form a liquid developer, supplying an amount of said developer to an applicator adjoining a recording medium sufficient to tone an image on said medium, purifying said developer, and replenishing said developer with said concentrate and said carrier in response to an amount of toner particles removed during said purification.

16. A method for continuous printing comprising:

providing a liquid concentrate having toner particles and charge agent, stirring said concentrate such that said concentrate is homogenized, providing a liquid carrier, combining said concentrate and said carrier to form a liquid developer, supplying an amount of said developer to an applicator adjoining a recording medium sufficient to tone an image on said medium, removing all but a residual volume of said developer from said applicator, supplying said carrier to said applicator to clean said applicator, removing all but a residual volume of said carrier from said applicator, purifying said carrier removed from said applicator, and returning said purified carrier to said developer.

17. A method for maintaining a liquid developer favorable for printing comprising:

providing a liquid concentrate including toner particles and charge agent, stirring said concentrate such that said concentrate is homogenized despite a low concentration of charge agent, providing a liquid carrier, combining said concentrate and said carrier to form a liquid developer, toning a latent image on a recording medium with said developer, thereby transferring some toner particles, charge agent and carrier to said medium, and replenishing said developer with an amount of said concentrate and said carrier determined by said toner particles, charge agent and carrier transferred to said medium.

18. The method of claim 17 further comprising providing a premixed developer.

19. The method of claim 17 further comprising:

purifying said developer of ionic contaminants acquired from said medium, and adding to said developer concentrate to replenish toner particles lost during said purification.

20. The method of claim 17 further comprising dispersing charge agent in said carrier in a concentration generally equal to that in said concentrate.

* * * * *